US007559156B2

(12) United States Patent
Renzo

(10) Patent No.: US 7,559,156 B2
(45) Date of Patent: Jul. 14, 2009

(54) CLOTHES DRYER DOOR ASSEMBLY

(75) Inventor: Pasquale Antonio Renzo, Anjou (CA)

(73) Assignee: Mabe Canada Inc., Burlington (CA)

( * ) Notice: Subject to any disclaimer, the term of this patent is extended or adjusted under 35 U.S.C. 154(b) by 381 days.

(21) Appl. No.: 11/430,934

(22) Filed: May 10, 2006

(65) Prior Publication Data

US 2006/0265899 A1 Nov. 30, 2006

(30) Foreign Application Priority Data

May 30, 2005 (CA) ..... 2508607

(51) Int. Cl.
*F26B 11/02* (2006.01)

(52) U.S. Cl. ..... 34/595; 34/601; 34/603; 34/605; 34/606; 49/381; 49/382; 49/463; 49/435

(58) Field of Classification Search ..... 34/595, 34/601, 602, 603, 605, 606, 610; 49/381, 49/382, 463, 465
See application file for complete search history.

(56) References Cited

U.S. PATENT DOCUMENTS 2,262,186 A * 11/1941 Lindberg ..... 34/607
2,315,354 A * 3/1943 Shanman ..... 34/82
2,417,998 A * 3/1947 Wales ..... 68/12.22
2,434,886 A * 1/1948 Pugh ..... 34/60
2,498,181 A * 2/1950 Reiter ..... 366/232
2,600,210 A * 6/1952 Constantine ..... 34/131
2,608,003 A * 8/1952 Tucker ..... 34/88
2,635,354 A * 4/1953 Geldhof et al. ..... 34/131
2,681,513 A * 6/1954 Fowler ..... 34/82
2,688,197 A * 9/1954 Kercheval ..... 34/596
2,707,837 A * 5/1955 Paulsen et al. ..... 34/607
2,718,711 A * 9/1955 Clark ..... 34/75
2,728,481 A * 12/1955 Robinson et al. ..... 220/4.02
2,792,640 A * 5/1957 Patterson ..... 34/75
2,827,276 A * 3/1958 Racheter ..... 432/62
2,927,380 A * 3/1960 Olthuis ..... 34/595
2,983,050 A * 5/1961 Alaback ..... 34/90
2,985,966 A * 5/1961 Martin ..... 34/75
3,010,217 A * 11/1961 Fuhring ..... 34/596
3,040,440 A * 6/1962 Mellinger et al. ..... 34/75
3,061,942 A * 11/1962 Scofield ..... 34/82
3,067,986 A * 12/1962 Grantham ..... 366/140
3,100,978 A * 8/1963 Howlett ..... 68/140
3,242,589 A * 3/1966 Jacobs ..... 34/595
3,263,343 A * 8/1966 Loos ..... 34/82
3,276,229 A * 10/1966 Deiss ..... 68/139

(Continued)

FOREIGN PATENT DOCUMENTS

CA 2091941 9/1994

(Continued)

*Primary Examiner*—Stephen M. Gravini

(57) ABSTRACT

A door assembly having a viewing window for use with a clothes dryer cabinet has a mask frame for masking the view of the door assembly and for securing an inner window in the assembly. The door assembly further utilizes the hinge structure and a horizontally disposed retainer to retain the inner window in place when the door assembly is complete. The inner window is mounted within the door assembly to slope downwardly and rearwardly of the inner door frame support. When the door is closed, the sloping inner window is positioned to cover a lint trap opening in the dryer while optimizing space within the dryer due to the sloping window wall.

33 Claims, 8 Drawing Sheets

U.S. PATENT DOCUMENTS

| | | | | | |
|---|---|---|---|---|---|
| 3,854,219 | A | * | 12/1974 | Staats | 34/265 |
| 3,959,891 | A | * | 6/1976 | Burkall | 34/82 |
| 4,112,590 | A | * | 9/1978 | Muller | 34/75 |
| 4,516,331 | A | * | 5/1985 | Yamauchi et al. | 34/77 |
| 4,522,311 | A | * | 6/1985 | Ikeda | 220/843 |
| 4,615,125 | A | * | 10/1986 | Wyborn | 34/92 |
| 4,669,199 | A | * | 6/1987 | Clawson et al. | 34/82 |
| 4,753,018 | A | * | 6/1988 | Golichowski | 34/603 |
| 4,934,559 | A | * | 6/1990 | Putnam | 220/377 |
| 5,113,562 | A | * | 5/1992 | Studt | 29/401.1 |
| 5,195,647 | A | | 3/1993 | Studt | |
| 5,459,945 | A | * | 10/1995 | Shulenberger | 34/605 |
| 5,651,188 | A | * | 7/1997 | Swanson et al. | 34/82 |
| 5,651,192 | A | * | 7/1997 | Horwitz | 34/529 |
| 5,664,339 | A | * | 9/1997 | Swanson et al. | 34/82 |
| 5,664,340 | A | * | 9/1997 | Brown | 34/275 |
| 5,940,988 | A | * | 8/1999 | Eisen | 34/596 |
| 5,953,831 | A | * | 9/1999 | Yu | 34/269 |
| 6,088,932 | A | * | 7/2000 | Adamski et al. | 34/274 |
| 6,135,130 | A | * | 10/2000 | Martineau | 134/113 |
| 6,195,910 | B1 | * | 3/2001 | Robineau | 34/417 |
| 6,223,452 | B1 | * | 5/2001 | Hamand | 34/267 |
| 6,381,874 | B1 | * | 5/2002 | Floyd | 34/602 |
| 6,732,447 | B2 | * | 5/2004 | Tomasi et al. | 34/90 |
| 6,761,049 | B2 | * | 7/2004 | Nitschmann et al. | 68/5 E |
| 6,766,596 | B1 | * | 7/2004 | Bienick et al. | 34/601 |
| 6,862,903 | B2 | * | 3/2005 | Nitschmann et al. | 68/5 E |
| 6,877,248 | B1 | * | 4/2005 | Cross et al. | 34/275 |
| 6,910,286 | B2 | * | 6/2005 | Hwang | 34/601 |
| 6,931,761 | B2 | * | 8/2005 | Hwang | 34/601 |
| 7,024,801 | B2 | * | 4/2006 | Hwang | 34/603 |
| 7,191,548 | B2 | * | 3/2007 | Salameh et al. | 34/380 |
| 7,299,666 | B2 | * | 11/2007 | Geyer et al. | 68/196 |
| 7,320,186 | B2 | * | 1/2008 | Schone | 34/603 |
| 7,325,330 | B2 | * | 2/2008 | Kim et al. | 34/407 |
| 7,363,781 | B2 | * | 4/2008 | Erickson | 68/196 |
| 2003/0046964 | A1 | | 3/2003 | Bollmann | |
| 2003/0115915 | A1 | | 6/2003 | Nitschmann et al. | |
| 2003/0172689 | A1 | * | 9/2003 | Fitton et al. | 68/12.26 |
| 2004/0020246 | A1 | * | 2/2004 | Yun et al. | 68/24 |
| 2004/0050117 | A1 | * | 3/2004 | Geyer et al. | 68/139 |
| 2004/0123489 | A1 | * | 7/2004 | Pancheri et al. | 34/597 |
| 2004/0123490 | A1 | * | 7/2004 | Pancheri et al. | 34/597 |
| 2004/0159009 | A1 | * | 8/2004 | Hwang | 34/601 |
| 2004/0159010 | A1 | * | 8/2004 | Hwang | 34/601 |
| 2004/0163275 | A1 | * | 8/2004 | Hwang | 34/601 |
| 2005/0034486 | A1 | * | 2/2005 | Bienick et al. | 68/3 R |
| 2005/0076532 | A1 | * | 4/2005 | Ward et al. | 34/597 |
| 2005/0086831 | A1 | * | 4/2005 | Ryu | 34/603 |
| 2005/0235519 | A1 | * | 10/2005 | Chung | 34/607 |
| 2006/0117596 | A1 | * | 6/2006 | Kim et al. | 34/607 |
| 2006/0123855 | A1 | * | 6/2006 | Erickson | 68/24 |
| 2006/0265899 | A1 | * | 11/2006 | Renzo | 34/603 |
| 2007/0051012 | A1 | * | 3/2007 | Schoene | 34/603 |
| 2007/0113421 | A1 | * | 5/2007 | Uhara et al. | 34/275 |
| 2007/0130790 | A1 | * | 6/2007 | Jung | 34/242 |
| 2007/0180728 | A1 | * | 8/2007 | Kim et al. | 34/88 |
| 2007/0227035 | A1 | * | 10/2007 | Leroy | 34/602 |
| 2009/0056161 | A1 | * | 3/2009 | Ahn et al. | 34/79 |
| 2009/0064534 | A1 | * | 3/2009 | LeClerc | 34/603 |
| 2009/0083991 | A1 | * | 4/2009 | Prajescu | 34/601 |
| 2009/0083992 | A1 | * | 4/2009 | Prajescu et al. | 34/601 |

FOREIGN PATENT DOCUMENTS

| | | | | |
|---|---|---|---|---|
| EP | 0 293 984 | B1 | | 12/1991 |
| GB | 21 18 580 | A | | 11/1983 |
| KR | 20030038735 | | * | 5/2003 |
| KR | 20040006241 | | * | 1/2004 |
| KR | 20040011218 | | * | 2/2004 |

* cited by examiner

CLOTHES DRYER DOOR ASSEMBLY

RELATED APPLICATION

The present application is related to Applicant's commonly assigned U.S. patent application Ser. No. 11/430,049 filed concurrently herewith and entitled Clothes Dryer Reversible Door Assembly.

FIELD OF THE INVENTION

The present invention relates to clothes dryers, and more particularly relates to a clothes dryer door assembly with a viewing window.

BACKGROUND OF THE INVENTION

A domestic clothes dryer typically has a cabinet including a front panel with an access opening through which clothes are loaded and unloaded into a rotating drum. The door is mounted through one or more hinges to the cabinet front panel on one side of the access opening.

Many of the viewing window type doors are port hole type doors where the clothes dryer has a front panel with a circular opening and a circular door jam. The door has a hinge that is mounted to the circular door jam. The dryer typically has a drum bulkhead or bearing mounted in the dryer adjacent the front panel of the dryer. The front panel and bulkhead share a circular opening that is cropped horizontally along the bottom of the opening permitting a lint trap duct to be placed between the front panel and the bulkhead. The trap duct receives a filter through which air exits the dryer drum. The door comprises an outer circular window of plastic and an inner glass window that is non-circular and is cropped to conform to the opening in the bulkhead of the dryer. The inner window is typically mounted vertically and in alignment with the drum bulkhead wall when the door is closed so as to cover the lint trap opening. In some instances the inner or rear window of the door is recessed back from the drum bulkhead to thereby increase the size of the dryer drum. However, in this instance, the lint trap opening may be exposed should a user forget to insert the lint filter into the trap. Some clothes dryers have a lint trap flap that springs up to close the lint trap opening when the lint trap is removed and thereby prevent clothing articles from being drawn into the trap duct. While the additional space in the dryer drum provided by the recessing of the inner window from the drum is an advantageous feature, the use of the lint trap flap adds expense to the construction of the clothes dryer.

Another feature of these port hole doors is the positive securement of the inner window in the door assembly. Typically, this involves the use of several fasteners that are secured against the inner window of the glass to hold the window in place. This requires the use of a more expensive glass pane for the inner window and the assembly of the fasteners is labor intensive.

Accordingly, there is a need for an improved door assembly for a clothes dryer that has a relatively simpler inner window mounting.

BRIEF DESCRIPTION OF THE INVENTION

The present invention relates to a door assembly having a viewing window for use with a clothes dryer cabinet. The door assembly comprises a mask frame for masking the view of the door assembly and for positioning an inner window in the assembly. The use of the mask frame for supporting the inner window reduces the number of fastening elements required to secure the inner window in place.

In one embodiment, the door assembly utilizes the hinge structure and a horizontally disposed retainer both of which secure the inner window positively in place.

In another embodiment, the inner window is mounted within the door assembly to slope downwardly and rearwardly of the inner door frame support. When the door is closed, the sloping inner window is positioned to cover a lint trap opening in the dryer while optimizing space within the dryer due to the sloping wall.

The door assembly further comprises an outer window spaced from the inner window. The outer or front window has a concave surface in one embodiment. The outer window in one embodiment is plastic and may comprises a polycarbonate plastic. The inner window may comprise glass or a moulded glass.

In one embodiment of the invention there is provided a door assembly adapted to be mounted to the clothes dryer cabinet. The door assembly comprises an inner door frame support comprising a first peripheral flange and a first collar depending rearwardly of the first peripheral flange defining a recessed window seat portion that surrounds a first central opening. The assembly comprises an inner window seated in the window seat portion and extending across the first central opening and a mask frame comprising a second collar depending rearwardly and overlaying the first collar of the inner door frame support for masking the inner door frame support. The second collar secures the inner window in the recessed window seat portion. The mask frame defines a second central opening. The assembly comprises a hinge structure secured with the inner door frame support and adapted to be secured with the clothes dryer cabinet. An outer window overlays the mask frame and the second central opening. The assembly further comprises an outer cover comprising a second peripheral flange covering a peripheral portion of the outer window and the inner door support frame. The outer cover is secured with the inner door frame support.

In another embodiment, the inner door frame support comprises two horizontally disposed hinge seat portions in the first peripheral flange. The hinge structure is secured in one of the horizontally disposed hinge seat portions and comprises a first hinge element extending from the inner door frame support and a second hinge element adapted to engage the inner window to positively hold the inner window in the recessed window seat portion. The assembly further comprises a retainer secured in the other one of the horizontally disposed hinge seat portions. The retainer comprises a retainer portion adapted to engage the inner window and positively hold the inner window in the recessed window seat portion. In another embodiment, the inner window comprises glass and a gasket surrounding the glass, and the second hinge element and the retainer portion engage the window gasket to secure the inner window in the recessed window seat portion.

In another embodiment of the present invention there is provided a door assembly adapted to be mounted to a clothes dryer cabinet. The assembly comprises an inner door frame support comprising a first peripheral flange and a first collar depending rearwardly of the first peripheral flange defining a recessed window seat portion that surrounds a first central opening. The assembly comprises an inner window seated in the window seat portion and extending across the first central opening. The assembly comprises a mask frame for masking the inner door frame support and defining a second central opening. The assembly comprises a hinge structure secured with the inner door frame support. The hinge structure comprises a first hinge element extending from the inner door frame support adapted for securement to the clothes dryer cabinet, and a second hinge element adapted to engage the inner window to secure the inner window in the recessed window seat portion. The assembly further comprises a retainer secured to the inner door frame support diametrically opposed from the hinge structure. The retainer comprises a retainer portion adapted to engage the inner window to secure the inner window in the recessed window seat portion. The assembly comprises an outer window overlaying the mask frame and the second central opening, and an outer cover. The outer cover comprises a second peripheral flange covering a peripheral portion of the outer window and the inner door frame support, and the outer cover being secured with the inner door frame support.

In another embodiment, the second hinge element and the retainer portion extend rearwardly between the first collar of the inner door frame support and the second collar of the mask frame. In another embodiment, the inner window comprises a flat surface portion surrounded by a gasket, and the second hinge element and the retainer portion engages the gasket of the inner window.

In another embodiment, the mask frame comprises a pair of opposing third peripheral flanges overlaying the first peripheral flange and defining horizontally disposed cut out slots adjacent the horizontally disposed hinge seat portions. The second collar depends rearwardly from the third peripheral flanges and the second collar has an inner surface and an outer surface. The outer surface is positioned facing the first collar and comprises a plurality of rearwardly extending rib spacers spaced about the outer surface of the second collar. The spacers each comprise a tip portion adapted to secure the inner window in the window seat portion.

In another embodiment each of the hinge and the retainer are removably secured to the inner door frame support by at least one fastener extending therethrough and into the inner door frame support.

BRIEF DESCRIPTION OF THE DRAWINGS

For a better understanding of the nature and objects of the present invention reference may be had by way of example to the accompanying diagrammatic drawings.

DETAILED DESCRIPTION OF THE INVENTION

Figure 1:
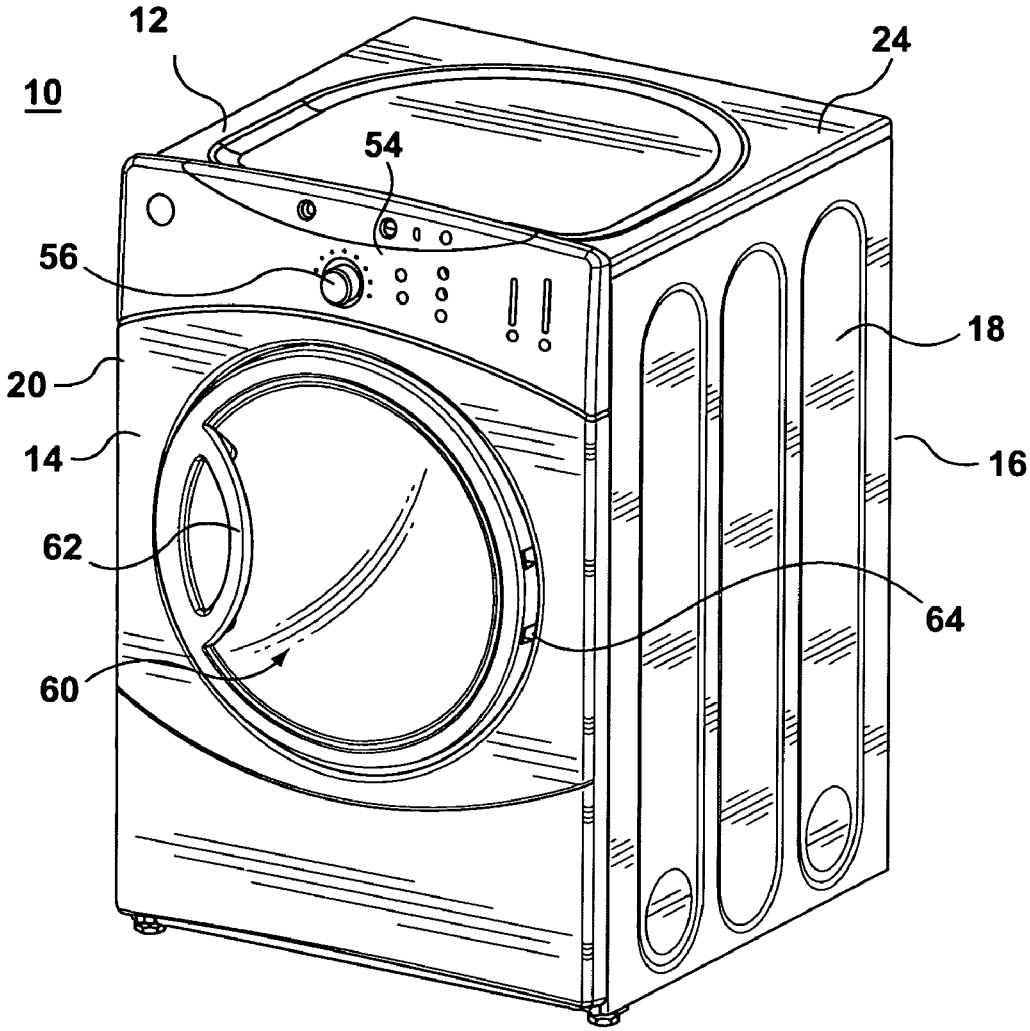
FIG. 1 is a perspective view of an exemplary clothes dryer that may benefit from the present invention.
Figure 2:
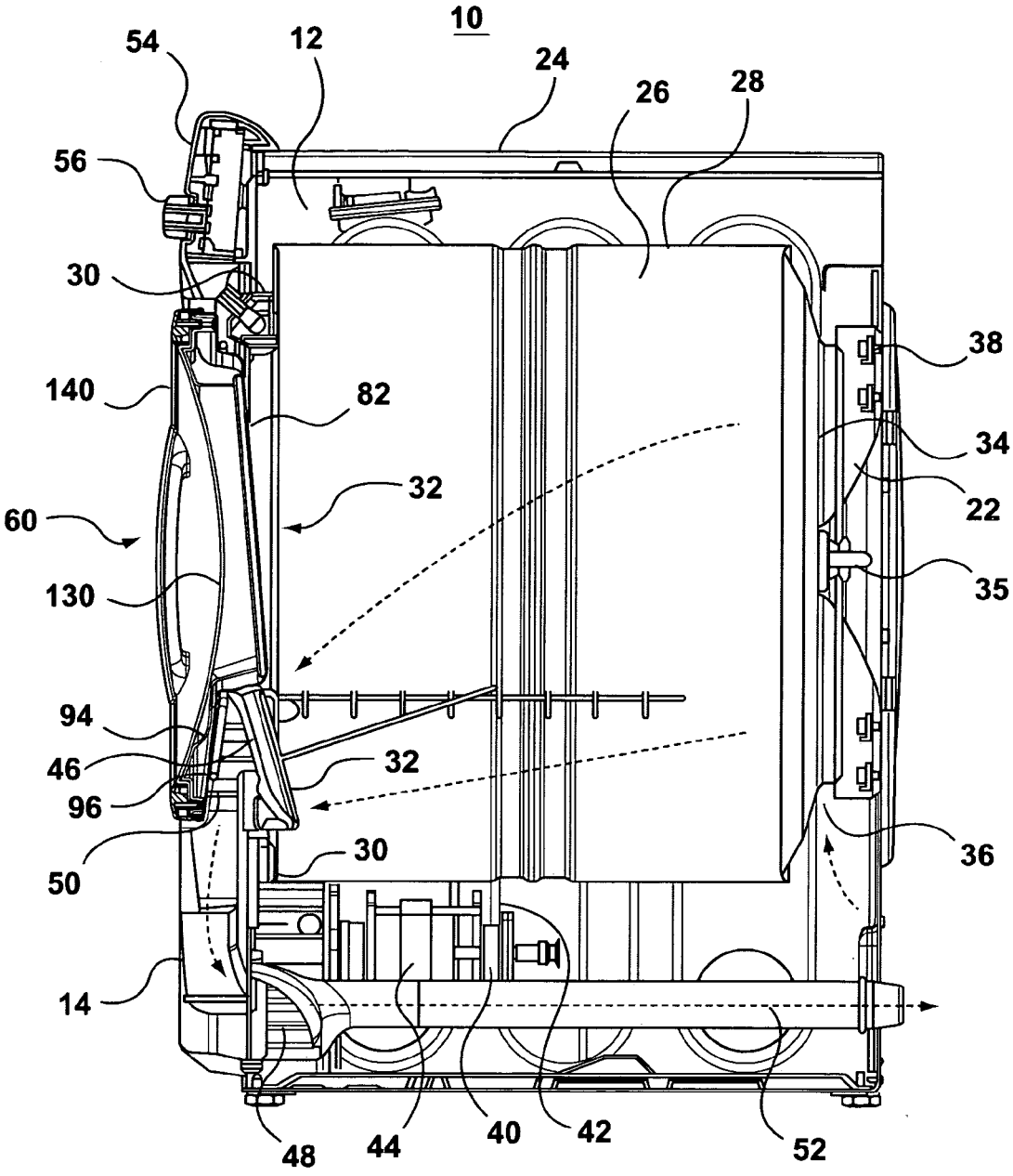
FIG. 2 is a side sectional view of an exemplary clothes dryer that may benefit from the present invention.

FIGS. 1 and 2 show perspective and side sectional views of an exemplary clothes dryer 10 that may benefit from the present invention. The clothes dryer includes a cabinet or a main housing 12 having a front panel 14, a rear panel 16, a pair of side panels 18 and 20 spaced apart from each other by the front and rear panels, and a top cover 24. Within the housing 12 is a drum or container 26 mounted for rotation around a substantially horizontal axis. A motor 44 rotates the drum 26 about the horizontal axis through, for example, a pulley 40 and a belt 42. The drum 26 is generally cylindrical in shape, has an imperforate outer cylindrical wall 28, and is closed at its front by a bulkhead wall or bearing 30 defining an opening 32 into the drum 26. Clothing articles and other fabrics are loaded into the drum 26 through the opening 32. A plurality of tumbling ribs (not shown) are provided within the drum 26 to lift the articles and then allow them to tumble back to the bottom of the drum as the drum rotates. The drum 26 includes a rear wall 34 rotatably supported within the main housing 12 by a suitable fixed bearing 35. The rear wall 34 includes a plurality of holes (not shown) that receive hot air that has been heated by a heater such as electrical heating elements 38 in the heater housing 22. The housing 22 receives ambient air via an inlet 36. Although the exemplary clothes dryer 10 shown in FIG. 1 is an electric dryer, it could just as well be a gas dryer having a gas burner. The heated air is drawn from the drum 26 by a blower fan 48 which is also driven by the motor 44. The air passes through a screen filter 46 which traps any lint particles. As the air passes through the screen filter 46, it enters a trap duct 50 and is passed out of the clothes dryer through an exhaust duct 52. After the clothing articles have been dried, they are removed from the drum 26 via the opening 32. The dryer has a control panel 54 with touch and or dial controls 56 whereby a user can control the operation of the dryer.

Clothes are inserted into, and removed from, the drum 26 through opening 32. Opening 32 is shown closed by a window or port-hole like door 60. Door 60 has a handle 62 for pivotally opening the door about hinge 64.

Figure 3:
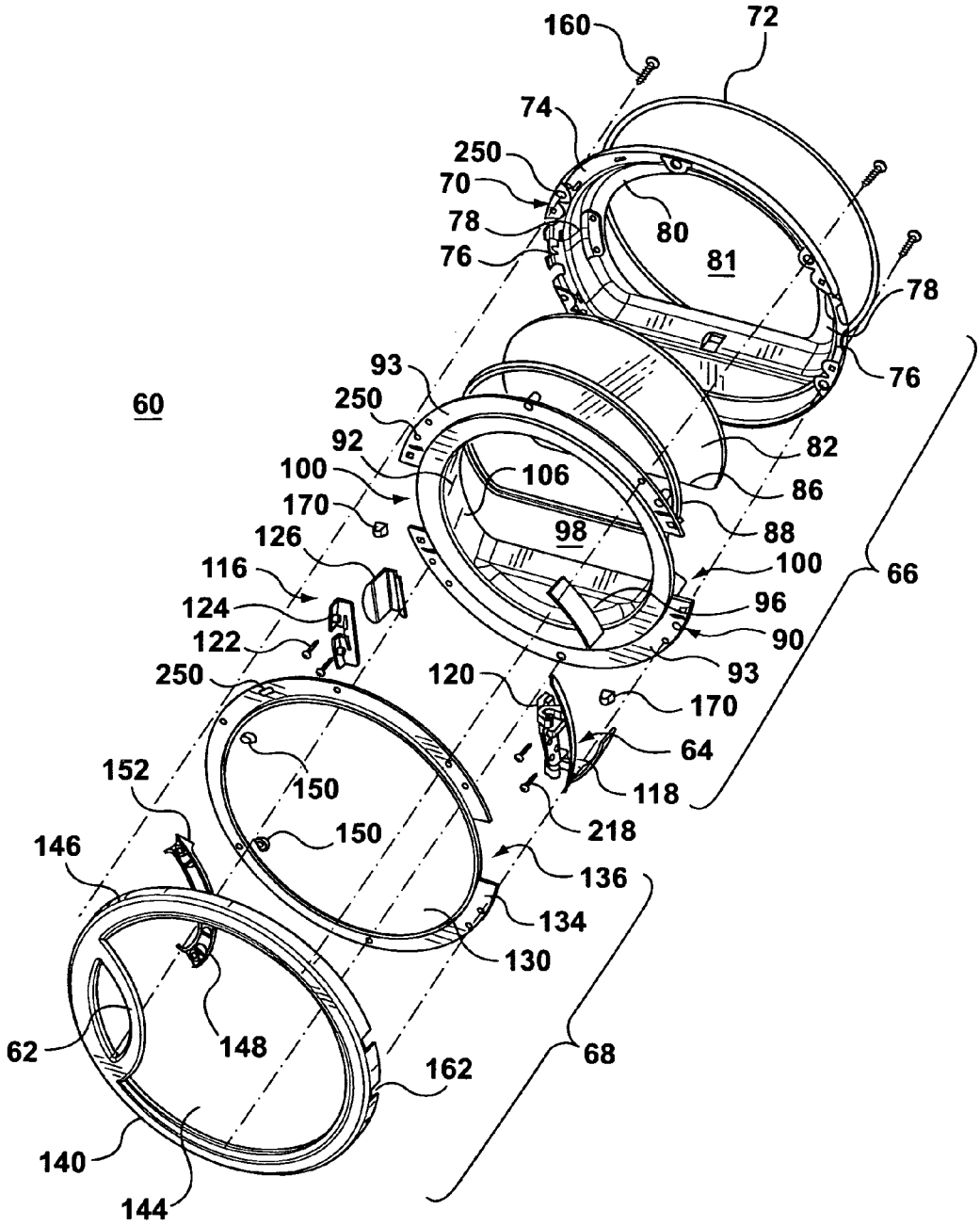
FIG. 3 is an exploded view of the clothes dryer door assembly of the present invention.

In accordance with the present invention, the assembly of the door 60 is now described with respect to FIGS. 3 through 9. In FIG. 3, the door assembly 60 is shown to comprise an inner door assembly 66 and an outer door assembly 68. The inner door assembly 66 comprises an inner door frame support 70. The inner door frame support is made from a steel or stainless steel material. The inner door frame support 70 is shown in perspective view in FIG. 9 with the inner window 82. Backed onto the inner door frame support 70 is a gasket 72 which forms a seal with a clothes dryer cabinet 12 when the door 60 is closed. The inner door frame support 70 comprises a first peripheral flange 74 that has two horizontally disposed or alternate hinge seat portions 76. The peripheral flange 74 comprises a circular flange that has a first collar 78 depending rearwardly therefrom. The collar 78 defines a recessed window seat portion 80 in the form of a lip portion. The recessed seat portion 80 surrounds a first central opening 81 in the inner door frame support 70.

The inner door assembly 66 further comprises an inner window 82. The inner window 82 comprises a flat glass piece which is circular in shape and has a truncated or cropped lower edge portion 86. In alternative embodiments, the glass may be a molded glass. The peripheral edge of the glass is surrounded by a gasket 88. The window 82 is adapted to be seated within the recessed seat portion 80 of the inner door frame support 70 so as to extend across the first central opening 81.

The inner door assembly 66 further comprises a mask frame 90 that is secured with the inner door frame support 70 to secure the window 82 in place in the window seat portion 80. The mask frame 90 is illustrated as a separate part in FIG. 7 and has a collar 92 that depends rearwardly from two arcuate peripheral flanges 93. The arcuate flanges 93 are adapted to overlay the peripheral flange 74 of the inner door frame support 70 and the mask collar 92 is adapted to overlay the collar 78 of the inner door frame support 70. The purpose of the mask frame 90 is two fold. Its first purpose is to mask from view the structure of the inner door frame support 70. The mask frame 90 has a lower portion 94 that also masks from view the lower portion 96 of the inner door frame support 70. It should be understood that the lower portion 94 of the inner door support frame 70 below collar 78 overlays the lint filter trap 50 between the front panel 14 and the bulk head wall 30 of the dryer when door 60 is closed (see FIG. 2). The second purpose of the mask frame 90 is to hold the window 82 in place in the recessed seat portion 80.

Figure 6:
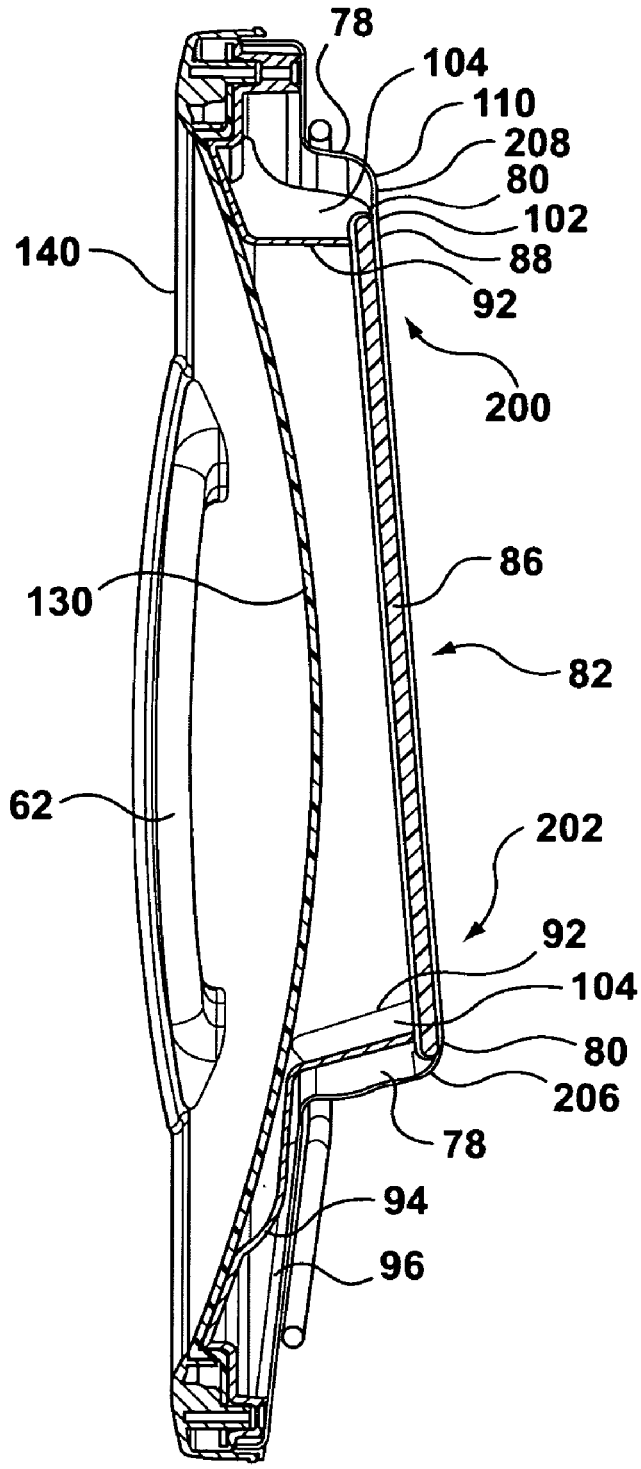
FIG. 6 is a sectional view of the door assembly taken through lines VI-VI of FIG. 4.

The mask frame 90 defines a second central opening 98. The mask frame 90 has two cut out slots 100 between the flanges 93. These cut out slots 100 are positioned adjacent to the horizontally disposed hinged seat portions 76 when the inner door assembly 66 is assembled. From FIG. 7, it can be seen that the collar 92 of mask frame 90 extends rearwardly from the peripheral flanges 93. The collar 92 comprises an inner surface 106 and an outer surface 108. The outer surface 108 is positioned to face towards the first collar 78 of the inner door frame support 70. The mask frame 90 further comprises rearwardly extending rib spacers 104 that are attached to the outer surface 108 of the collar 92. These spacers 104 have a tip 110 with a cut out section 102. The tip 110 together with the cut out section 102 of the ribs 104 act to secure the inner window 82 within the recessed seat portion 80 of the inner door frame support 70 when the mask frame 90 is secured to the inner door frame support 70. In FIG. 6, it can also be seen that the spacer or ribs 104 have a tip portion 110 with its cut out slot 102 that surrounds and engages the gasket 88 of the inner window 82.

Figure 7:
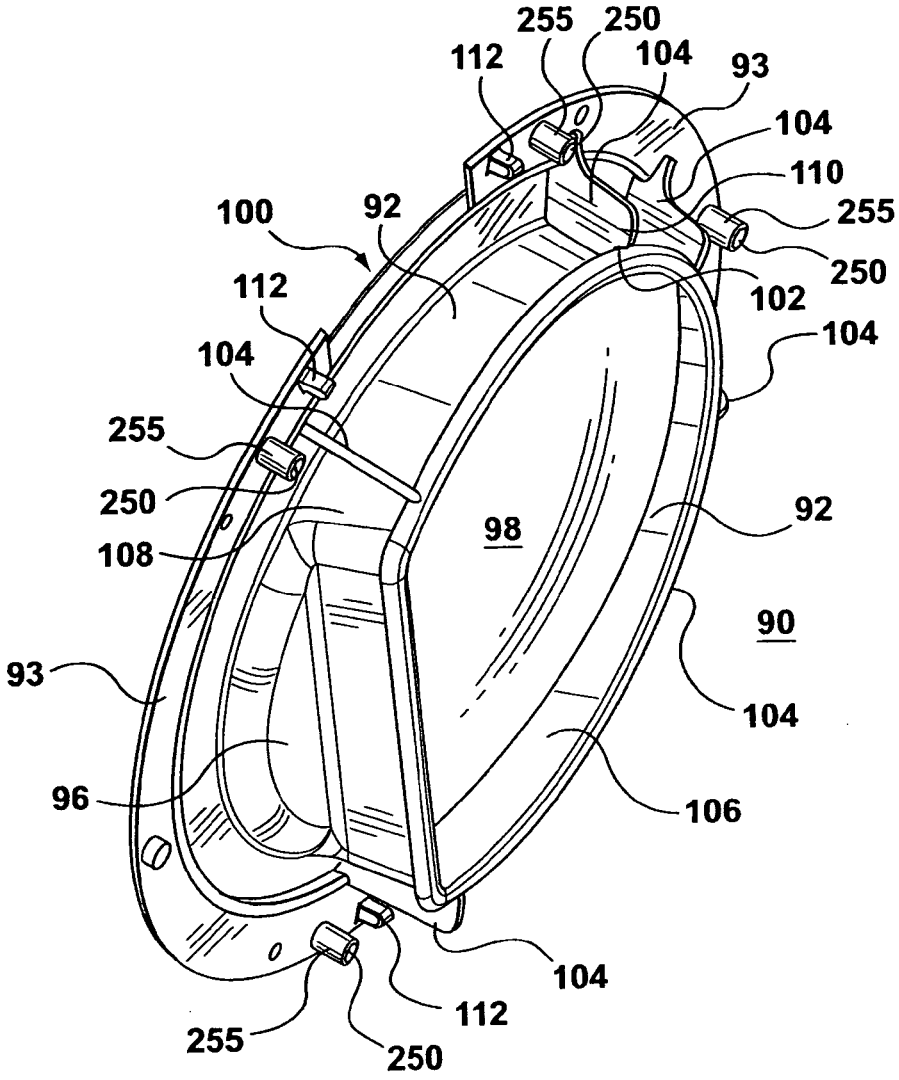
FIG. 7 is a rear perspective view of the mask frame of the door assembly.
Figure 8:
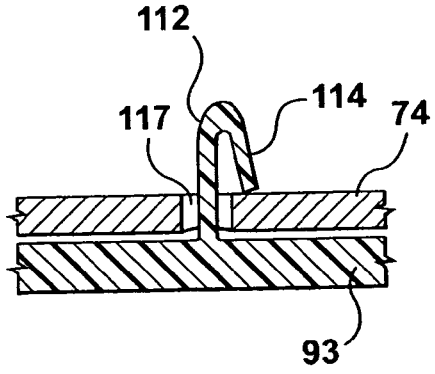
FIG. 8 is an enlarged view showing the connection made by the barb-like connectors of the present invention; and, FIG. 9 is an inside perspective view of the inner door frame support, inner window, the hinge and retainer.

Referring to FIG. 7, the peripheral flanges 93 of the mask frame 90 each comprise a plurality of barb like connectors 112. As better seen in FIG. 8, the barb like connector 112 has a hook portion 114 that passes through an opening 117 in the first peripheral flange 74 of the inner door frame support 70. As the barb connector 112 passes through opening 117, the hook portion 114 is compressed and then springs open to lock the peripheral flanges 93 relative to the peripheral flange 74. In this way the barb connectors 112 in co-operation with the openings 117 act to assemble the mask frame 90 relative to the inner door frame support 70 with the window 82 sandwiched between the mask frame 90 and the inner door support frame 70. As shown in FIG. 7, the rear face of the flanges 93 have spacers 255 with pass through apertures 250. Spacers 255 together with barb connectors 112 maintain the relative positioning of the mask frame 90 and the inner door frame support 70. Hence the connectors 112 and the openings 117 co-operate to assemble the inner door assembly 66 without the use of any fasteners.

Referring to FIG. 6 the distance the recesses of the collars 78 and 92 rearwardly extend is greater at the lower portion 202 of the door than at the upper portion 200 of the door. This results in the recessed window seat portion 80 sloping downwardly and rearwardly to present a lower seat portion 206 thereof that is more recessed than the upper seat portion 208. As a result the inner window 82 seated in the recessed seat portion 80 slopes downwardly and rearwardly towards the interior of the dryer cabinet. The lower seat portion 80 extends over the lint trap 46 (as best seen in FIG. 2). This results in a door effectively covering the opening for the filter 46 in the trap duct 50 while at the same time optimizing volume within the dryer drum.

Figure 5:
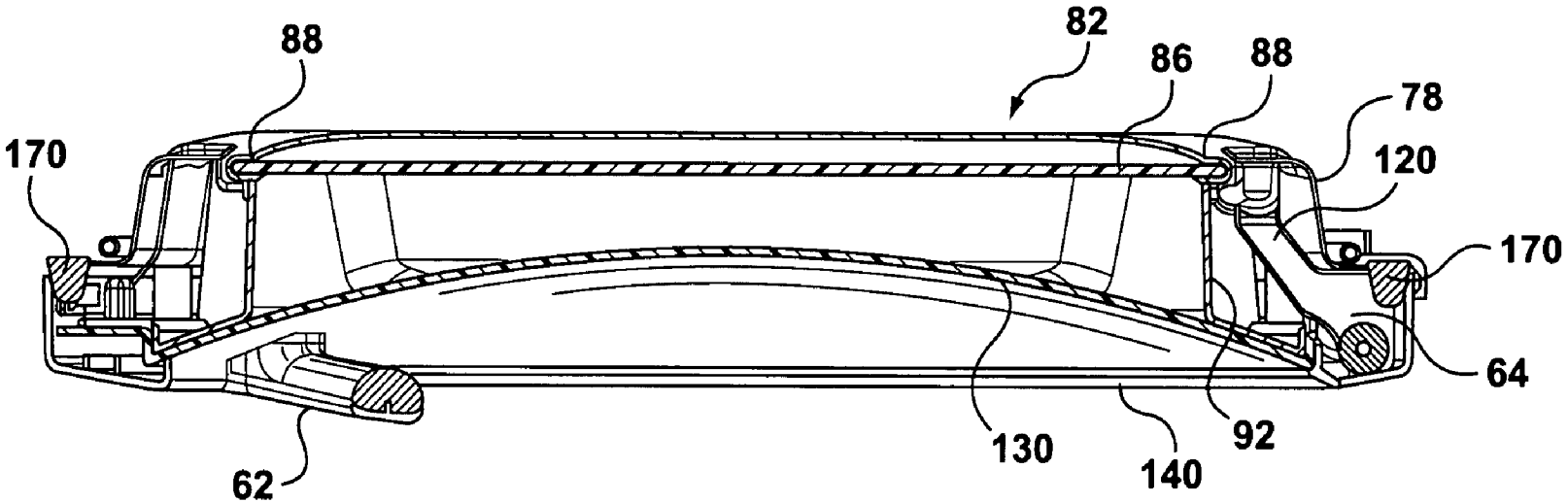
FIG. 5 is a sectional view of the door assembly taken through lines V-V of FIG. 4.
Figure 9:
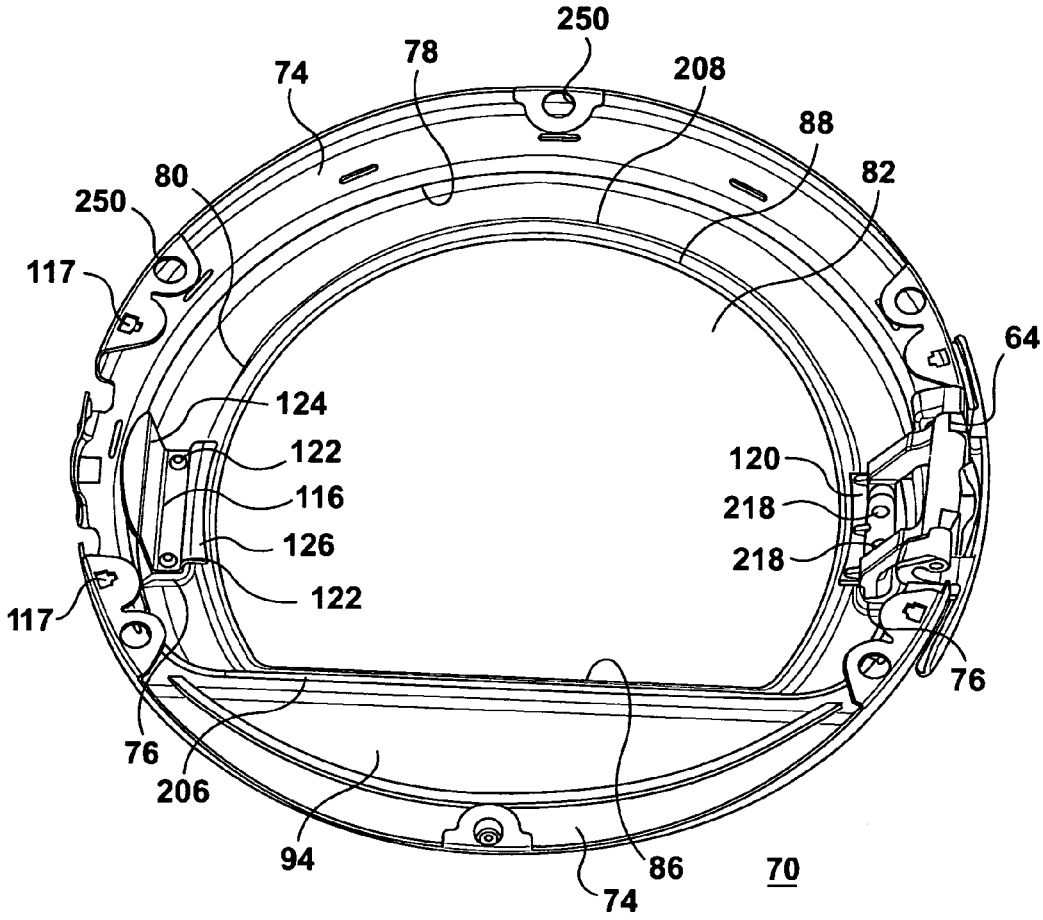

Referring to FIGS. 3, 5, and 9, the inner door assembly 66 further comprises hinge 64 and retainer 116. The hinge structure 64 is secured to the inner door frame support 70 by fasteners 218 that pass through openings in the hinge structure 64 and into corresponding openings in the seat portions 76 of the inner door support frame 70. The hinge structure 64 is secured in one of the horizontally disposed hinged seat portions 76 of the inner door frame support 70. The hinge structure 64 has a first hinge element 118 (FIG. 3) that extends from the inner door assembly 66 for securement with the front panel 14 and/or bulk head 30 of the dryer adjacent the opening 32. As shown in FIGS. 5 and 9, the hinge structure 64 has a second hinge element 120 that is adapted to engage the inner window 82 at the gasket 88 to secure the window 82 in the recessed seat portion 80. The hinge element 120 of the hinge structure 64 extends rearwardly between the collar 78 of the inner door frame support 70 and collar 92 of the mask frame 90.

In a similar manner the retainer 116 is removably mounted by fasteners 122 in the other one of the horizontally disposed hinged seat portions 76 of the inner door support frame. The retainer 116 comprises a cover 124 and a retainer portion 126. The retainer portion 126 is adapted to engage the gasket 88 of the inner window 82 to positively hold the window 82 in the recessed seat portion 80. In the detailed description the hinge 64, retainer 116 and mask frame 90 act to hold the window 82 in place on the inner door frame support 70. It should be understood that either the mask frame 90 or the hinge 64 and retainer 116 may be used mutually exclusive of each other to secure the window 82 in place on the inner door frame.

Referring to FIG. 3, the door assembly 60 further includes an outer door assembly 68. The outer door assembly 68 comprises an outer window 130. The outer window 130 comprises a concave circular shaped central portion surrounded by a peripheral ring like flange 134. The flange 134 extends substantially around the circular concave center portion except for the cut out section 136. Cut out section 136 is located adjacent the hinge element structure 64. The outer window 130 comprises a plastic and preferably comprises a transparent polycarbonate material. The outer door assembly 68 further comprises a cover 140 that has a peripheral flange 142 comprising a ring flange with a central opening 144. The cover 140 has a depending rim 146 that depends from its peripheral flange 142. The peripheral flange 142 is further provided with an outer handle portion shown as 62. The outer door assembly 68 further comprises a structural handle portion 148 that is mounted by two fasteners 156 passing through apertures 150 in the outer window 130, apertures 152 in the handle portion 148 and into receiving studs (not shown) in the reverse face of the outer handle portion 62. The fasteners 156 effectively secure the outer window 130 to the cover 140 and thereby complete the assembly of the outer door assembly 68. The outer window 130 provides further structural support for the door assembly 60.

The peripheral ring like flange 134 of the outer window 130 is nested in the ring like peripheral flange 142 and the rim 146 of the cover 140. The flange 134 is substantially coextensive with the peripheral flange 142 of the cover 140 except for the cut out portion 136 that is provided to allow the cover flange 142 to overlay the hinge structure 64.

To complete the assembly of the door 60 the inner door 66 is secured to the outer door 68 by a plurality of fasteners 160 that pass through aligned apertures 250 in the peripheral flange 74 of the inner door frame support 70, the peripheral flanges 93 of the mask frame 90, the peripheral flange 134 of the outer window 130 and into receiving studs (not shown) found on the rear surface of the peripheral flange 142 of the cover member 140.

Additionally latches or spacers 170 (see FIGS. 3 and 5) are provided to mount and orientate the hinge element 164 and the retainer portion 126 and cover 124 in the respective horizontally disposed seat portion 76.

Figure 4:
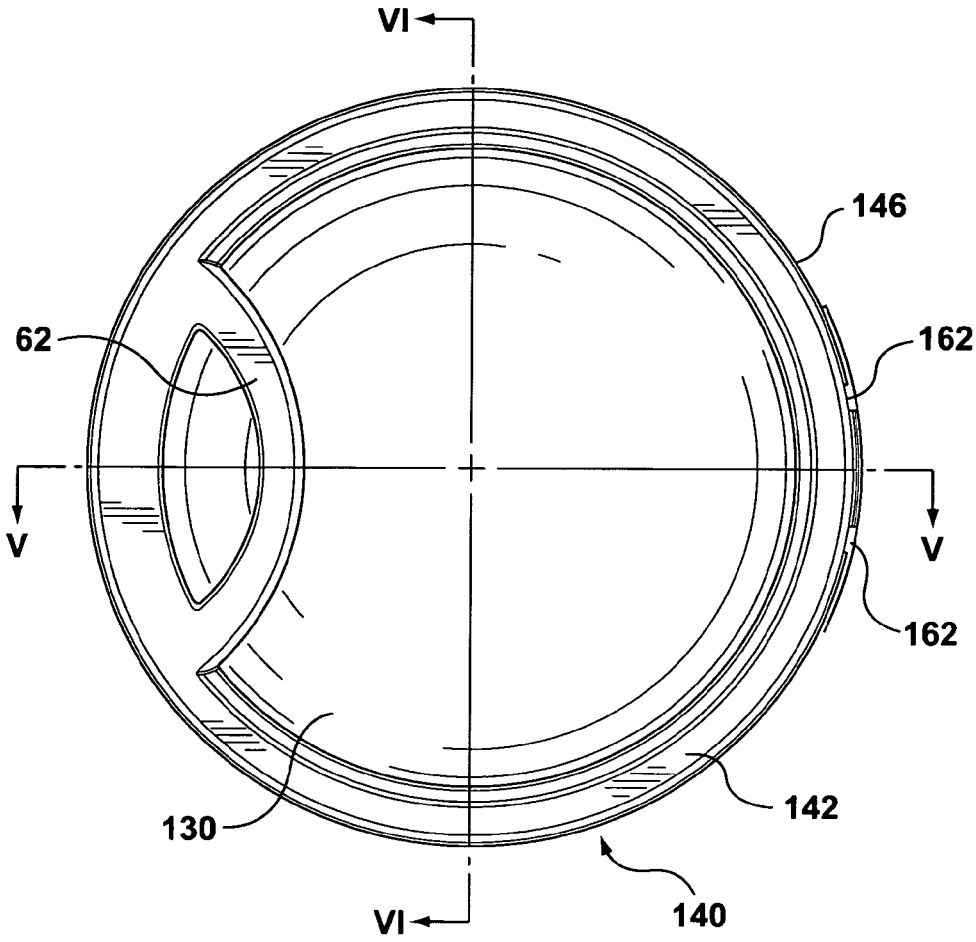
FIG. 4 is a front view of the door assembly of FIG. 3.

Referring to FIG. 4, the front cover 140 covers the appearance of the door such that the central opening 144 of the front cover and the central opening 98 of the mask frame 90 are covered by the concave shaped circular central portion of the outer window 130. Disposed horizontally opposite to the handle 62 on the rim 146 of the cover 140 are two slotted openings 162. Openings 162 permit for the first hinge element 118 to extend from the door assembly 60 for connection with the clothes dryer cabinet.

The construction of the clothes dryer door assembly 60 allows for a the mask frame 90 to be secured to the inner door frame support 70 so as to hold the inner window 82 in place without having to utilize additional fasteners other than the hinge 64 and the retainer 126 to hold the window 82 in place. Further, the door structure of the present invention is adapted for reversibility or for rotation of the outer door assembly 68 relative to the inner door assembly 66.

The door assembly 60 is adapted to be mounted in alternate positions on the front panel 14 of the clothes dryer cabinet 12 so that the door assembly 60 can be configured to open either from the left or ride side. As shown in FIG. 1 the door assembly 60 opens from the left side of the dryer 10. If one were to reverse the opening of the door this can be done by removing the door assembly 60 at the hinge structure 64 from the clothes dryer cabinet 12. Next, the fasteners 160 are removed so that the outer door assembly 68 is removed from the inner door assembly 66. Thereafter the hinge structure 66 and the retainer 116 are removed by removing fasteners 218 and 122. The hinge 64 and the retainer 116 are then rotated 180 degrees from their initial position into the other or alternate horizontally disposed seat portion 76. Then the hinge structure 64 and the spacer 126 are reattached by fasteners 218 and 122. The outer door assembly 68 is then rotated 180 degrees relative to the inner door assembly 66. The fasteners 160 are reinserted to secure the outer door assembly 68 to the inner door assembly 66. This is facilitated by the apertures 250, through which the fasteners 160 pass, being aligned symmetrical to each other about the horizontal axis extending through the door assembly 60. This symmetrical or mirroring arrangement facilitates placement of the outer door assembly 68 relative to the inner door assembly 66 at 180 degrees disposed from its previous position. The hinge structure 64 is then reattached to the dryer housing 12 to complete the reversing of the door relative to the dryer 10. Rotation of the outer door assembly 68 relative to the inner door assembly 66 permits for the dryer to be changed between left and right opening doors without completely disassembling each of the inner door assembly 66 and the outer door assembly 68 while at the same time maintaining the lower portions 94 and 96 of the inner drum support 70 and the mask frame 90 in the same orientation adjacent the lint trap duct 50.

While the invention has been described in terms of various specific embodiments, those skilled in the art will recognize that the invention can be practiced with modifications within the spirit and scope of the present invention disclosed herein.

What is claimed is:

1. A door assembly adapted to be mounted to a clothes dryer cabinet, said door assembly comprising:

an inner door frame support comprising a first peripheral flange and a first collar depending rearwardly of the first peripheral flange defining a recessed window seat portion that surrounds a first central opening;

an inner window seated in the window seat portion and extending across the first central opening;

a mask frame comprising a second collar depending rearwardly and overlaying the first collar of the inner door frame support for masking the inner door frame support, the second collar securing the inner window in the recessed window seat portion, and the mask frame defining a second central opening;

a hinge structure secured with the inner door frame support and adapted to be secured with the dryer cabinet;

an outer window overlaying the mask frame and the second central opening; and, an outer cover comprising a second peripheral flange covering a peripheral portion of the outer window and the inner door support frame, and the outer cover being secured with the inner door frame support.

2. The door assembly of claim 1 wherein the inner door frame support comprises two horizontally disposed hinge seat portions in the first peripheral flange, and the hinge structure is secured in one of the horizontally disposed hinge seat portions and comprises a first hinge element extending from the inner door frame support and a second hinge element adapted to engage the inner window to secure the inner window in the recessed window seat portion and wherein the door assembly further comprises a retainer secured in the other one of the horizontally disposed hinge seat portions, the retainer comprising a retainer portion adapted to engage the inner window and secure the inner window in the recessed window seat portion.

3. The door assembly of claim 2 wherein the second hinge element and the retainer portion extend rearwardly between the first collar of the inner door frame support and the second collar of the mask frame.

4. The door assembly of claim 3 wherein the inner window comprises a flat surface portion surrounded by a gasket, and the second hinge element and the retainer portion engage the gasket to secure the inner window to the inner door frame support.

5. The door assembly of claim 1 wherein the recessed window seat portion is recessed in a downward and rearward slope to present a lower seat portion thereof more recessed than an upper seat portion thereof, and the inner window seated in the recessed window seat portion comprises a flat surface portion that slopes downwardly and rearwardly towards an interior of the dryer cabinet when the door is closed.

6. The door assembly of claim 5 wherein the lower seat portion extends over a lint trap opening for the dryer when the door assembly is closed.

7. The door assembly of claim 2 wherein the mask frame comprises a pair of opposing third peripheral flanges overlaying the first peripheral flange and defining horizontally disposed cut out slots adjacent the horizontally disposed hinge seat portions, the second collar depending rearwardly from the third peripheral flanges and the second collar having an inner surface and an outer surface, the outer surface being positioned facing the first collar and comprising a plurality of rearwardly extending rib spacers spaced about the outer surface of the second collar, and the spacers each comprising a tip portion adapted to secure the inner window in the window seat portion.

8. The door assembly of claim 7 wherein the third peripheral flanges of the mask frame each comprise a plurality of barb-like connectors extending rearwardly thereof, and the first peripheral flange of the inner door frame support has corresponding recesses to the barb-like connectors adapted to receive and retain the barb connectors to thereby secure the mask frame with the inner door frame support.

9. The door assembly of claim 1 wherein the inner window is a circular window with a cropped lower edge and the outer window is a circular window.

10. The door assembly of claim 9 wherein the inner window comprises molded glass and the outer window is a plastic material.

11. The door assembly of claim 2 wherein each of the hinge and the retainer is removably secured to the inner door frame support by at least one fastener extending therethrough and into the inner door frame support.

12. The door assembly of claim 1 wherein the mask frame comprises one or more third peripheral flanges overlaying the first peripheral flange, the second collar depending rearwardly from each of the third peripheral flanges and the second collar having an inner surface and an outer surface, the outer surface being positioned facing the first collar and comprising a plurality of rearwardly extending rib spacers spaced about the outer surface of the second collar, and the spacers each comprising a tip portion adapted to secure the inner window in the window seat portion.

13. The door assembly of claim 12 wherein the third peripheral flanges of the mask frame each comprises a plurality of barb-like connectors extending rearwardly thereof, and the first peripheral flange of the inner door frame support has corresponding recesses to the barb-like connectors adapted to receive and retain the barb connectors to thereby secure the mask frame with the inner door frame support.

14. The door assembly of claim 1 wherein the mask frame comprises one or more third peripheral flanges overlaying the first peripheral flange, and wherein the third peripheral flanges of the mask frame each comprises a plurality of barb-like connectors extending rearwardly thereof, and the first peripheral flange of the inner door frame support has corresponding recesses to the barb-like connectors adapted to receive and retain the barb connectors to thereby secure the mask frame with the inner door frame support.

15. The door assembly of claim 1 wherein the outer cover comprises a handle secured to the outer window by fasteners passing through the outer window into studs in the handle.

16. The door assembly of claim 2 wherein the door assembly is secured together by a plurality of fasteners passing through aligned apertures in the inner door frame support, mask frame, and the outer window, and into aligned studs protruding from an inside surface of the outer cover.

17. A door assembly adapted to be mounted to a clothes dryer cabinet, said door assembly comprising:

an inner door frame support comprising a first peripheral flange and a first collar depending rearwardly of the first peripheral flange defining a recessed window seat portion that surrounds a first central opening;

an inner window seated in the window seat portion and extending across the first central opening;

a mask frame for masking the inner door frame support and defining a second central opening;

a hinge structure secured with the inner door frame support, the hinge structure comprising a first hinge element extending from the inner door frame support adapted for securement with the clothes dryer cabinet, and comprising a second hinge element adapted to engage the inner window and to secure the inner window in the recessed window seat portion;

a retainer secured to the inner door frame diametrically opposed from the hinge structure, the retainer comprising a retainer portion adapted to engage the inner window and to secure the inner window in the recessed window seat portion;

an outer window overlaying the mask frame and the second central opening; and, an outer cover comprising a second peripheral flange covering a peripheral portion of the outer window and the inner door frame support, and the outer cover being secured with the inner door frame support.

18. The door assembly of claim 17 wherein the inner door frame support comprises two horizontally disposed hinge seat portions in the first peripheral flange, and the hinge structure is secured in one of the horizontally disposed hinge seat portions and wherein the retainer is secured in the other one of the horizontally disposed hinge seat portions.

19. The door assembly of claim 18 wherein the mask frame comprises a second collar depending rearwardly and overlaying the first collar of the inner door frame support for masking the inner door frame support, and the second collar securing the inner window in the recessed window seat portion.

20. The door assembly of claim 19 where in the second hinge element and the retainer portion extend rearwardly between the first collar of the inner door frame support and the second collar of the mask frame.

21. The door assembly of claim 19 wherein the inner window comprises a flat surface portion surrounded by a gasket, and the second hinge element and the retainer portion engaging the gasket of the inner window.

22. The door assembly of claim 17 wherein the recessed window seat portion is recessed in a downward and rearward slope to present a lower seat portion thereof more recessed than an upper seat portion thereof, and the inner window seated in the recessed window seat portion comprises a flat surface portion that slopes downwardly and rearwardly towards an interior of the dryer cabinet.

23. The door assembly of claim 22 wherein the lower seat portion extends over a lint trap opening for the dryer when the door assembly is closed.

24. The door assembly of claim 19 wherein the mask frame comprises a pair of opposing third peripheral flanges overlaying the first peripheral flange and defining horizontally disposed cut out slots adjacent the horizontally disposed hinge seat portions, the second collar depending rearwardly from the third peripheral flanges and the second collar having an inner surface and an outer surface, the outer surface being positioned facing the first collar and comprising a plurality of rearwardly extending rib spacers spaced about the outer surface of the second collar, and the spacers each comprising a tip portion adapted to secure the inner window in the window seat portion.

25. The door assembly of claim 24 wherein the third peripheral flanges of the mask frame each comprise a plurality of barb-like connectors extending rearwardly thereof, and the first peripheral flange of the inner door frame support has corresponding recesses to the barb-like connectors adapted to receive and retain the barb connectors to thereby secure the mask frame with the inner door frame support.

26. The door assembly of claim 17 wherein the inner window is a circular window with a cropped lower edge and the outer window is a circular window.

27. The door assembly of claim 26 wherein the inner window comprises molded glass and the outer window is a plastic material.

28. The door assembly of claim 17 wherein each of the hinge and the retainer is removably secured to the inner door frame support by at least one fastener extending therethrough and into the inner door frame support.

29. The door assembly of claim 17 wherein the mask frame comprises one or more third peripheral flanges overlaying the first peripheral flange, the second collar depending rearwardly from each of the third peripheral flanges and the second collar having an inner surface and an outer surface, the outer surface being positioned facing the first collar and comprising a plurality of rearwardly extending rib spacers spaced about the outer surface of the second collar, and the spacers each comprising a tip portion adapted to secure the inner window in the window seat portion.

30. The door assembly of claim 29 wherein the third peripheral flanges of the mask frame each comprises a plurality of barb-like connectors extending rearwardly thereof, and the first peripheral flange of the inner door frame support has corresponding recesses to the barb-like connectors adapted to receive and retain the barb connectors to thereby secure the mask frame with the inner door frame support.

31. The door assembly of claim 17 wherein the mask frame comprises one or more third peripheral flanges overlaying the first peripheral flange, and wherein the third peripheral flanges of the mask frame each comprises a plurality of barb-like connectors extending rearwardly thereof, and the first peripheral flange of the inner door frame support has corresponding recesses to the barb-like connectors adapted to receive and retain the barb connectors to thereby secure the mask frame with the inner door frame support.

32. The door assembly of claim 17 wherein the outer cover comprises a handle secured to the outer window by fasteners passing through the outer window into studs in the handle.

33. The door assembly of claim 17 wherein the door assembly is secured together by a plurality of fasteners passing through aligned apertures in the inner door frame support, mask frame, and the outer window, and into aligned studs protruding from an inside surface of the outer cover.

* * * * *